US005190413A

United States Patent [19]

Carey

[11] Patent Number: 5,190,413

[45] Date of Patent: Mar. 2, 1993

[54] EARTHWORK SYSTEM

[75] Inventor: John M. Carey, Ashburn, Va.

[73] Assignee: The Neel Company, Springfield, Va.

[21] Appl. No.: 757,901

[22] Filed: Sep. 11, 1991

[51] Int. Cl.[5] ..... E02D 29/02

[52] U.S. Cl. ..... 405/286; 52/286; 52/589; 405/262; 405/284

[58] Field of Search ..... 405/284, 285, 286, 262, 405/258; 52/589, 596, 608, 606

[56] References Cited

U.S. PATENT DOCUMENTS

| | | | |
|---|---|---|---|
| 1,723,930 | 8/1929 | Giesler | 52/286 |
| 3,184,014 | 5/1965 | Nightingale . | |
| 3,421,326 | 1/1969 | Vidal . | |
| 3,686,873 | 8/1972 | Vidal . | |
| 4,175,888 | 11/1979 | Ijima | 52/606 X |
| 4,324,508 | 4/1982 | Hilfiker et al. | 405/284 |
| 4,369,004 | 1/1983 | Weatherby | 405/262 |
| 4,449,857 | 5/1984 | Davis | 405/286 |
| 4,514,113 | 4/1985 | Neumann | 405/284 X |
| 4,725,170 | 2/1988 | Davis | 405/284 X |
| 4,917,543 | 4/1990 | Cole et al. | 405/262 |
| 4,929,125 | 5/1990 | Hilfiker . | |
| 4,952,098 | 8/1990 | Grayson et al. . | |
| 4,983,076 | 1/1991 | Vidal . | |
| 4,993,879 | 2/1991 | Hilfiker . | |

*Primary Examiner*—Dennis L. Taylor

*Attorney, Agent, or Firm*—Dennison, Meserole, Pollack & Scheiner

[57] ABSTRACT

A retaining wall formed of rhombus-shaped panels which, when stacked, form continuous joint lines at approximately 30° to the horizontal. The panels are internally reinforced and include centrally located, embedded, projecting connectors interlocked to earth embedded soil reinforcing mats selectively mounting resistance enhancing friction blocks. The panels are formed with truncated angles to define, upon assembly, permanent weep holes.

14 Claims, 11 Drawing Sheets

FIG. 4
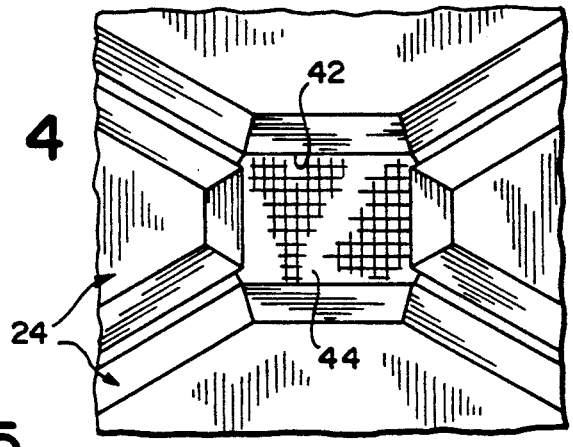
FIG. 5
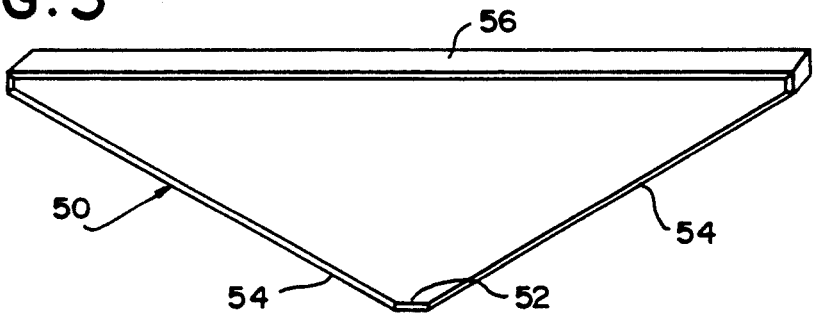
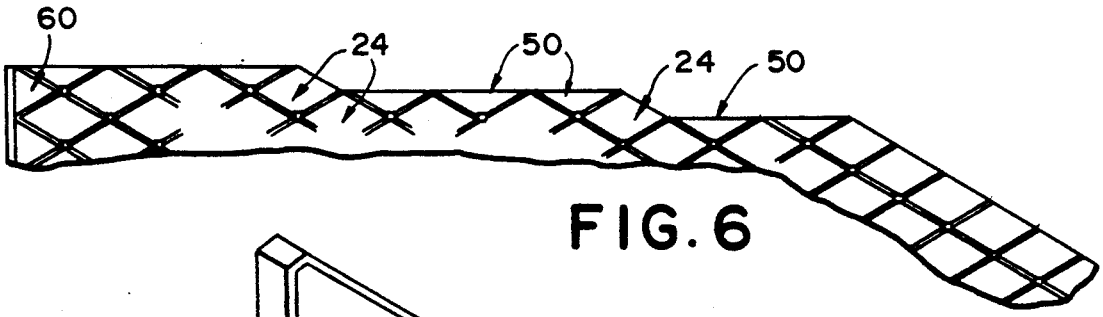
FIG. 6
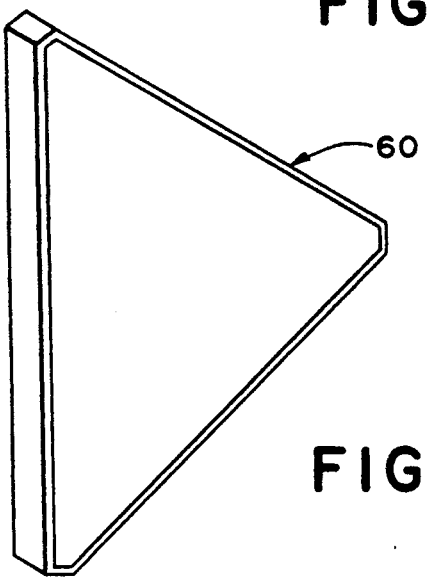
FIG. 7

FIG. 16
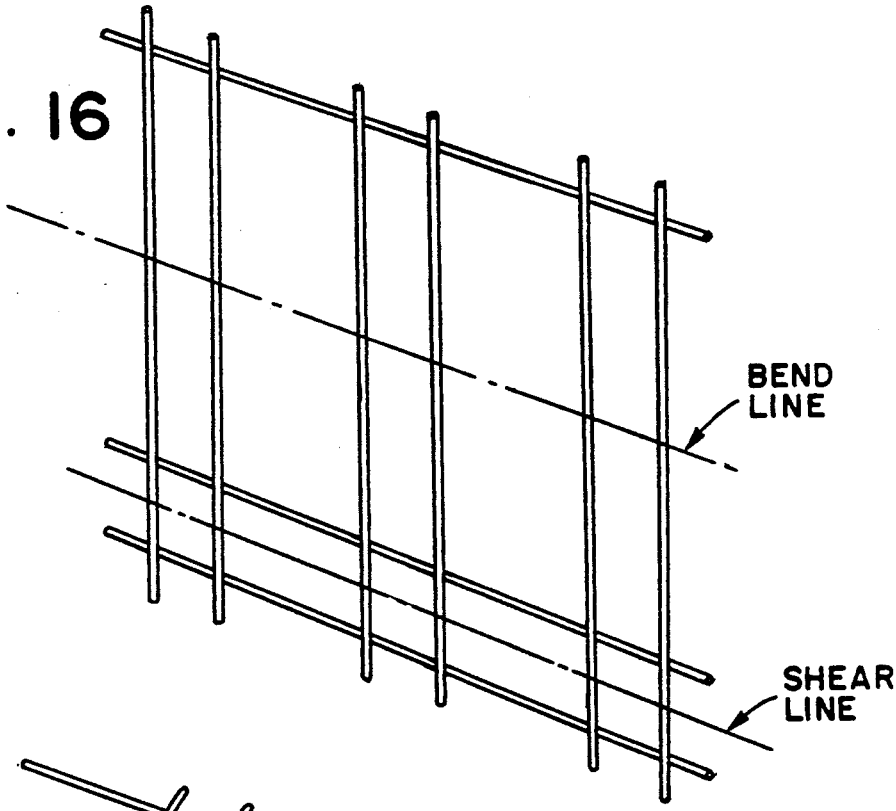
FIG. 17
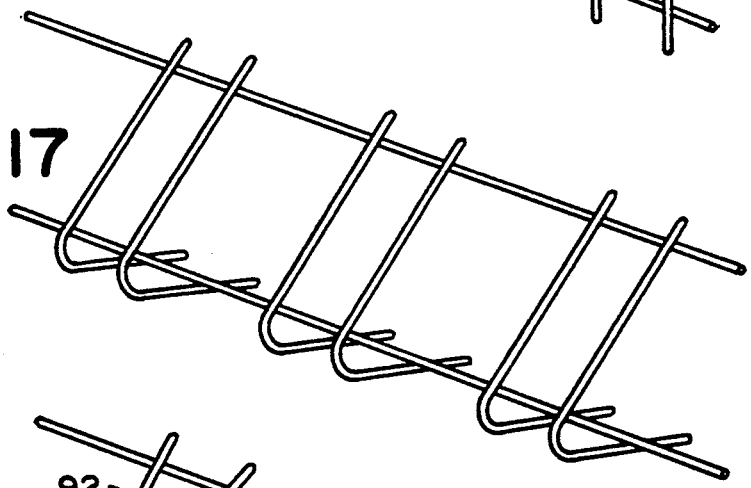
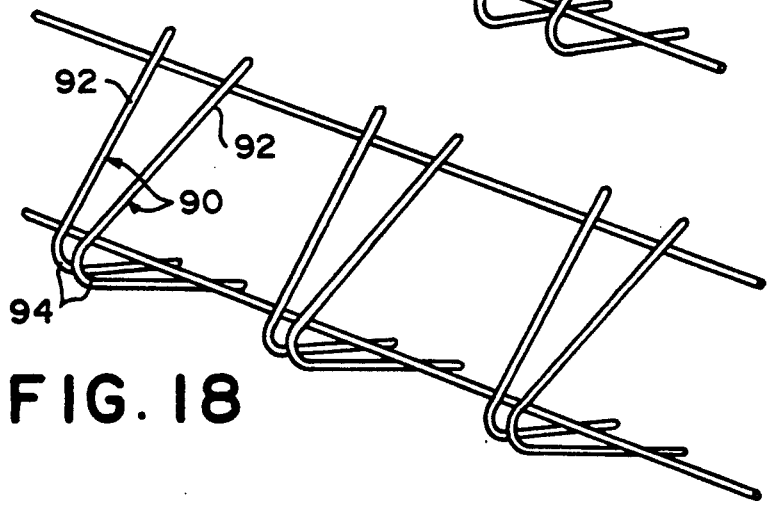
FIG. 18

FIG. 23
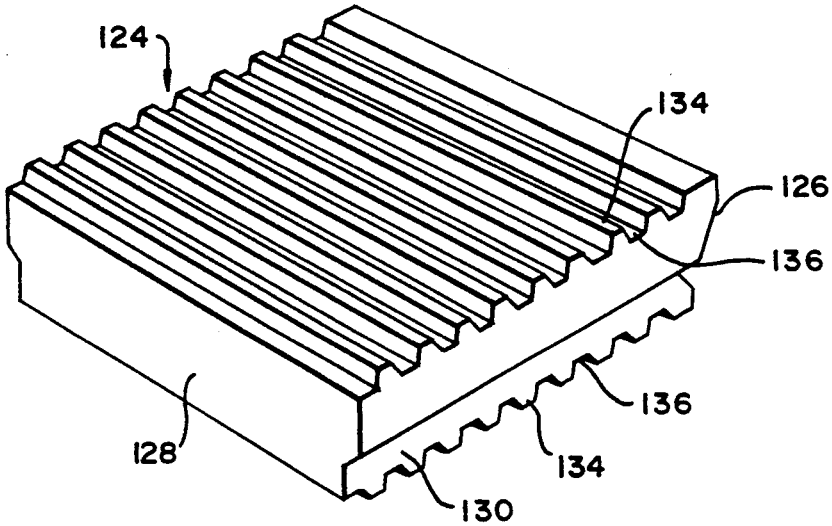
FIG. 24
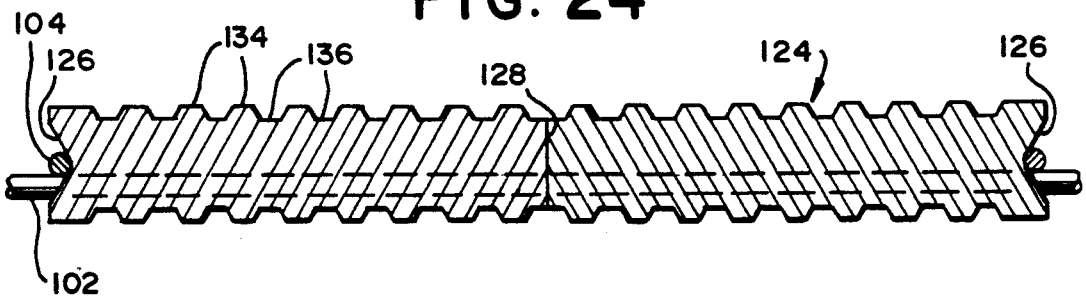
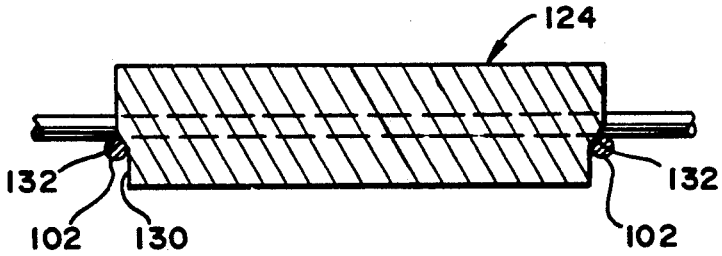
FIG. 25

FIG. 26
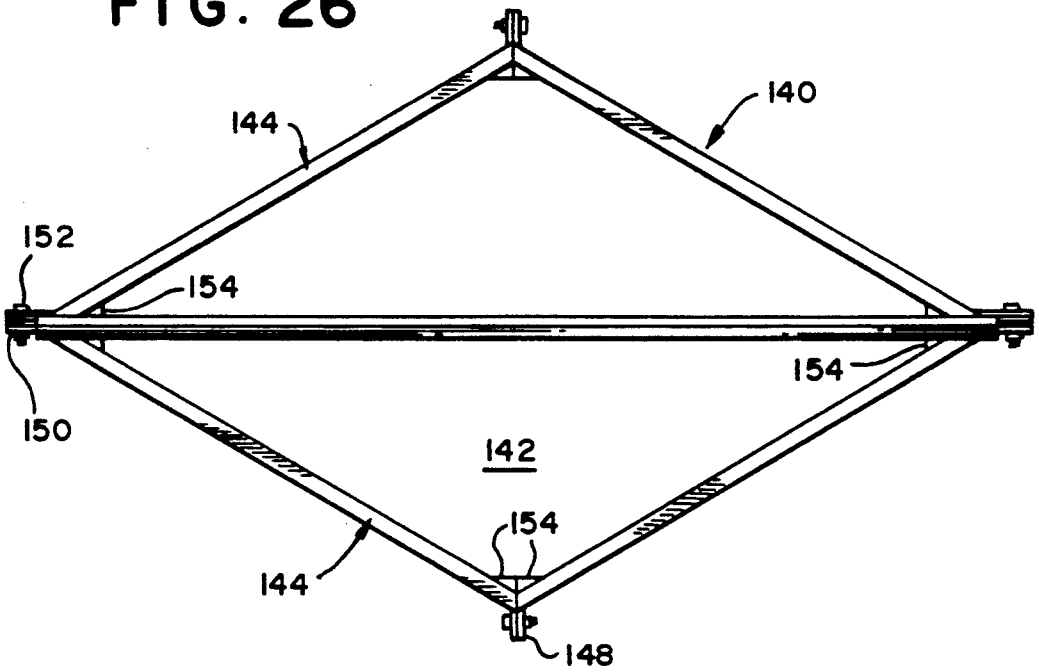
FIG. 27
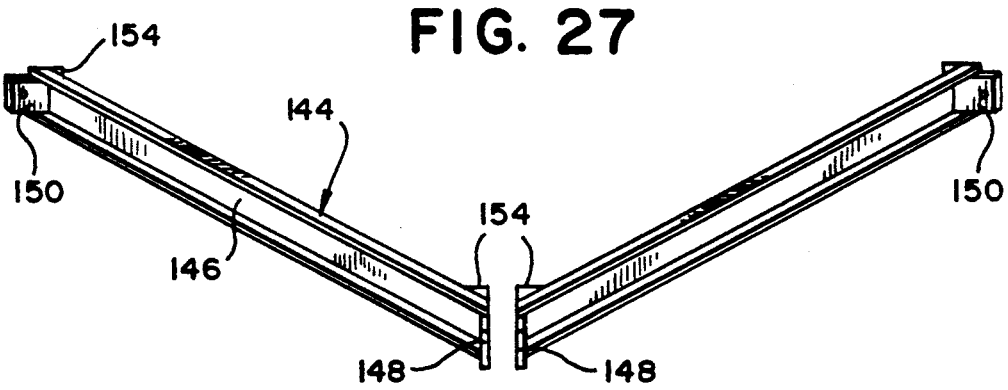
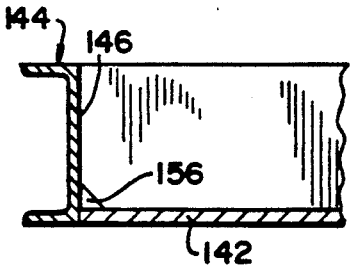
FIG. 28

EARTHWORK SYSTEM

BACKGROUND OF THE INVENTION

Systems for the retention and stabilization of soil and soil-like materials exist in many forms and are utilized in a wide variety of circumstances including as earth retaining walls, bridge abutments, materials storage areas, and the like.

While such retaining systems can use a variety of materials, for larger systems as herein contemplated the structures are normally formed of reinforced concrete, either poured in situ as a unitary structure, or, preferably, formed of an assemblage of stacked precast reinforced concrete blocks or panels with soil reinforcements.

Many efforts have been directed toward improving various aspects of such soil retaining systems, as evidenced by continuing patent activity in this area.

In the known systems, the panels which form the face of the wall are usually quite massive and are provided with configured edges to mate with the edges of adjacent panels to define a positive interlock therewith in an effort to resist relative movement therebetween. The actual configurations of the known panels, normally rectangular or hexagonal, are primarily a function of the ease with which the panel can be formed, handled and stacked. The panels, particularly with walls of any appreciable height, are provided with anchoring systems which engage the panel, for example through connectors embedded within the panel, and extend rearwardly therefrom for embedment within the backfill soil. Such anchoring systems can comprise flat strips of steel or mats of reinforcing rods or wire, precast concrete stems, and the like.

The walls, including the bulk of the panels, the reinforcement therein, the strength of the edge interlock between the panels, and the strength of the soil embedded reinforcement or anchoring system are normally engineered in accord with the anticipated soil load to be retained. This in turn frequently requires specialized design considerations for different projects, with the ultimate goal being to produce a solid wall providing an immovable barrier to earth movement. Any potential for possible shifting of the wall or panels thereof is in most cases avoided by over designing. Notwithstanding the care taken, it is not unknown for cracks or fracture lines to form. Such fracture lines will normally be seen to occur on generally diagonal lines crossing panels themselves and/or following a generally jagged path through selective edge joiners. Such fractures, and the bulk of the loads developed on the formed wall normally result from the natural shrinkage, consolidation and settling of the backfill soil and closely follow the shear planes for a soil in the Rankine passive state.

The Rankine Theory, developed over 100 years ago and well known, basically states that the shear planes for a body of cohesionless soil in a passive state of plastic equilibrium, that is with every part undergoing shrinkage and on verge of failure, will extend at an angle of $45°-\phi/2$. The angle of internal friction of a soil is called $\phi$. The backfill soils used in these structures are cohesionless and have a $\phi$ angle that varies from 28° to 34°. Therefore shear plane angles for the backfill soils in the passive state range from 31° to 28°. It is the presence of these shear planes, and the potential for wall failure that result therefrom, that heretofore have been accommodated as above described by the use of massive wall systems and without particular regard to the actual nature of the stresses introduced into the wall.

SUMMARY OF THE INVENTION

The shape of the earthwall facing panel of the invention was developed to follow the lines of stress that occur naturally in the soil as it consolidates. The system uses facing panels of a rhomboid shape with the 30° angle of the panel being a good approximation of the shear plane angle that exists as the soil material settles. This results in a wall system with joint lines existing at 30° to the horizontal. The soil reinforcements attach to the horizontal centerlines of these panels.

Most retaining walls are designed using the Rankine theory to calculate the soil pressures on the wall. The walls are analyzed using a cross-section through the wall to determine the amount and magnitude of the soil pressure to be resisted This is also the case with the present system the soil pressure is considered to be in the Rankine active case in that it is expanding or pushing out against the wall structure or facing. This procedure is followed to arrive at the amount and length of the soil reinforcements used to support the facing. The system falls into the category of retaining walls known as mechanically stabilized earth walls. These walls are backfilled with cohesionless soil and have an angle of internal friction that varies from 28° to 34°. The angle of internal friction is usually called phi and given the symbol $\phi$.

What is not commonly considered in this class of structures is the forces that are created as the select backfill around the soil reinforcements begins to settle or undergo shrinkage under the influence of gravity. This is normally called consolidation of the backfill and the soil pressure is considered to be in the Rankine passive state. In this situation one is concerned about the forces and lines of shear that exist in the backfill that run parallel to the front face of the wall. It is possible to design a wall that is stable under the active pressure of the soil but has no ability to handle the consolidation forces that could occur as the backfill settles unevenly.

The system is designed with this fact in mind. The Rankine theory states that the lines of shear in the passive case for a body of cohesionless soil in a state of plastic equilibrium, that is with every part undergoing shrinkage and on the verge of failure, will extend at an angle of $45°-\phi/2$. Given the normal range of $\phi$ angles for the backfill soils used; the shear plane angles range from 31° to 28°.

The system panel uses an angle of 30°, closely approximating the lines of shear in the settling backfill. This line of free movement not only exists in the facing panel array but is followed by the pattern of arrangement of soil reinforcements as well. Thus, in the event of excessive or uneven consolidation of the backfill the wall system can adjust itself and relieve the buildup of soil forces without damage to the structural components.

In summary, the earthwork structure of the invention is designed to accommodate, in a unique manner, the stresses inherent in wall-retained soil or similar loads through a balanced system including a novel panel design and related stacked panel relationship, and an anchoring system forming therewith a construction which is economical, durable and cost effective in all aspects thereof, including materials, manufacturing procedures and wall assembly.

In achieving the objects of the invention, the panels are specifically configured and so stacked as to accommodate normal soil shear planes in a manner not heretofore contemplated. Basically, the panels are in the shape of a rhombus with confined angles of approximately 60° and 120° which, upon stacking with the 60° angles on the horizontal, position the equilateral edges at approximately 30° to the horizontal. The panels are both horizontally and vertically aligned, and define continuous joint or jointer lines at 30° to the horizontal in an isometric grid pattern. The formed joint lines thus closely correspond to the natural shear planes of the soil and can uniquely relieve the inherent soil pressures and stresses resulting from a consolidation or settling of the soil in a manner which will not affect the structural integrity of the formed wall, nor require excess load carrying capacity.

The panels will be provided with flat edges stacked with drainage pads therebetween and without a positive interlock to allow for free accommodation of soil movement by a degree of slippage along the continuous 30° joint lines and in the plane of the wall without panel fracture or the like. In addition to the drainage pads, positive weep holes are defined at each joinder between four adjacent panels as a result of a specific truncating of the panel angle corners, thus insuring proper soil moisture drainage regardless of whether or not drainage can be maintained between the overlying panel edges.

The wall anchoring system utilizes soil embedded welded wire mats selectively provided with concrete friction blocks in accord with anticipated loading, wall height, and the like. The soil reinforcement mats anchor to a mid-height connector in each panel which in turn internally engages the embedded panel reinforcement. The single centrally located connector provides for a constant loading of each panel in the manner of a cantilever with the inner face of the panel under tension and the outer face under compression whereby the placement of the internal reinforcement need accommodate only one form of stress, as compared to the multiple stresses inherently introduced into a panel with multiple connectors which will normally produce both beam and cantilever loading.

The invention is also concerned with the formation of the panels, and utilizes a forming system which provides for a simultaneous embedment of the panel reinforcement and the connector with the connector comprising a major component of the support system for the wire and a means for removal of the panel subsequent to the forming thereof.

Other features, objects and advantages of the invention will become apparent from the more detailed description of the invention following hereinafter.

BRIEF DESCRIPTION OF THE DRAWINGS

FIG. 4 is an enlarged plan detail of a weep hole defined between adjacent panel ends;

FIG. 5 is a perspective view of a horizontal half panel;

FIG. 6 is a schematic illustration of the use of horizontal half panels to define a wall slope;

FIG. 7 is a perspective view of a vertical half panel;

FIGS. 16, 17 and 18 schematically illustrate a portion of the sequence in forming a connector;

FIG. 23 is an enlarged perspective view of a friction block;

FIG. 24 is a longitudinal cross-sectional detail through a pair of mounted friction blocks;

FIG. 25 is a transverse cross-sectional detail through a mounted friction block;

FIG. 26 is a plan view of form work for molding a panel in accord with the present invention;

FIG. 27 is a perspective view of two of the side rails of the form work of FIG. 26;

FIG. 28 is a vertical cross-sectional view through the form work at one side rail;

DESCRIPTION OF THE PREFERRED EMBODIMENTS

Figure 1:
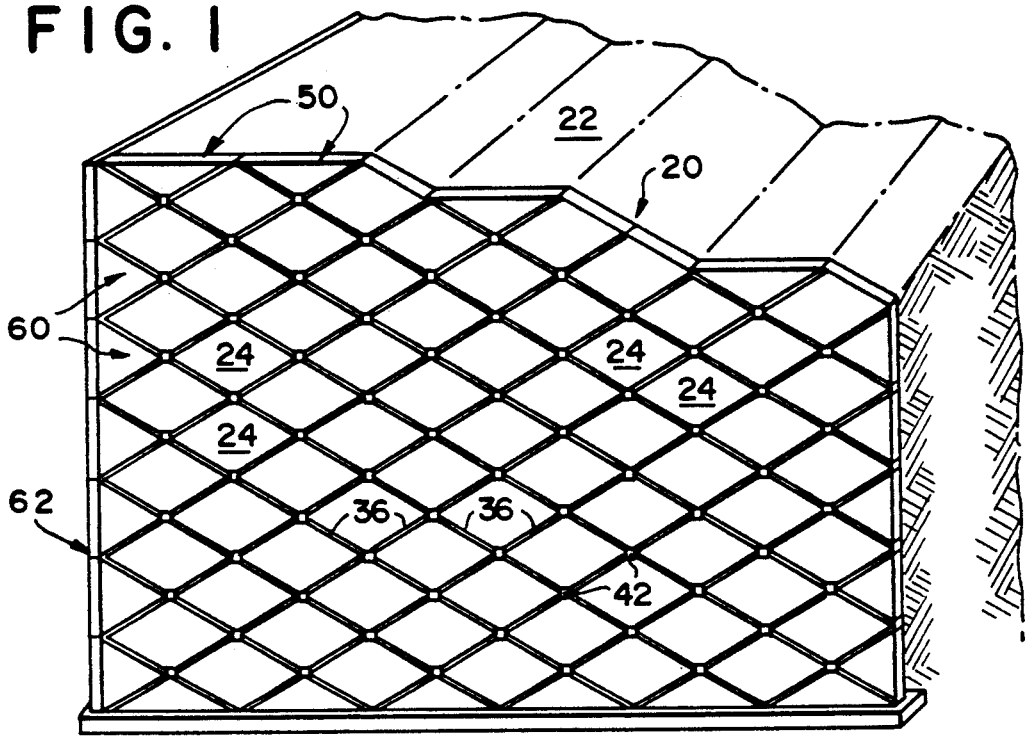
FIG. 1 is a perspective view of an earth retaining wall system.

Referring now more specifically to the drawings, the earthwork system of the invention comprises a facing wall 20 as a major component of a wall system adapted to retain and/or contain a loose fill material 22, most commonly earth or soil.

The principal elements of the wall system 20 are modular blocks or panels 24 of a rigid load-accommodating construction. As can be appreciated, the size of the panels 24 can vary in accord with the size and nature of the wall to be formed thereby. For example, for home use, as in the formation of low garden walls, 65 pound concrete panels, which can be manually placed, can be used. For purposes of the present disclosure description, the panels 24 will be considered for use in massive retaining walls, such as roadside earth stabilization systems, bridge abutments, mechanically stabilized earth systems (M.S.E.), and the like. Accordingly, the panels as presented in the drawings will be formed of reinforced cast concrete approximately 7.5 feet in length 4.5 feet in height and 5.5 inches thick. Such a panel will weight approximately 1200 to 1500 pounds and require mechanical lift and placing equipment.

The panels 24 are generally rhomboidal, and more specifically in the shape of a rhombus or equilateral parallelogram defined by a pair of horizontally aligned equilateral triangles with a common vertically extending base line 26 therebetween. The modular panels 24 are, in the wall 20, oriented with the apex and base angles 28 and 30 vertically aligned and with the opposed side angles 32 horizontally aligned. The apex and base angles 28 and 30 are approximately 120° with the adjoining upper and lower panel side edges 34 extending therefrom at approximately 30° to the horizontal and defining side angles of approximately 60°. So configured, the modular panels 24, when stacked as a retaining wall 20 or the like, define a generally isometric grid pattern with the joint lines 36 extending at approximately 30° to the horizontal. The panels 24 are stacked with the apex and base angles 28 and 30 of superimposed panels in vertical alignment, and with the side angles 32 of horizontally adjacent panels in horizontal alignment whereby the defined joints or joint lines 36 extend continuously throughout the extent of the formed wall at the aforementioned 30° angle. The above described panel configuration and wall grid arrangement thereof are of great significance in providing a wall system which has superior strength and durability, and which in fact provides what is believed to be the optimum in soil stabilization panels and walls through a specific consideration of basic soil characteristics. More particularly, it has long been known that a body of free-flowing cohesionless soil has a passive condition angle of $(45° - \phi/2)$ or approximately 30°. Soil stress conditions develop shear planes throughout a mass of consolidated soil acted upon by no force other than gravity, which project at a 30° angle. This theory, developed by Rankine in the mid 1800's and known as the Rankine theory, is both well known and accepted in engineering practice.

The system of the invention by formation of the joint lines 36 at approximately 30° to correspond to the normally encountered stress or shear planes of the retained soil, allows relief of soil stresses in the plane of the wall by a degree of slippage along the joint lines in a safe and controlled manner without damage to the panels. This ability for a controlled relief of inherent soil stresses is enhanced by the substantially greater joint length provided between individual panels by the "30°" rhombus configuration of the panels 24 as compared to square or hexagonal panels. For example, with panels of equal area, the ratio of area to joint length is 1 to 3.46 for the rhombus configuration, 1 to 1.61 for a square panel, and 1 to 1 for a hexagonal panel. A similar substantial length advantage would occur for panels having equal side lengths.

The longer joint length minimize pressure on the joint material and the panel edges themselves, with the longer bearing joint surfaces allowing for the possible use of thinner and/or more economical material within the joint.

Figure 2:
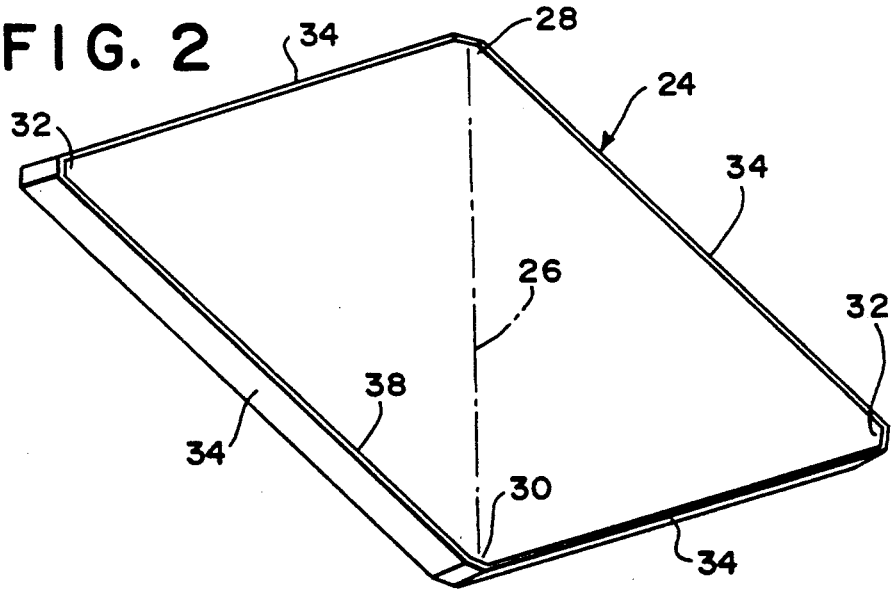
FIG. 2 is an enlarged perspective view of a full modular panel used in the wall system.
Figure 3:
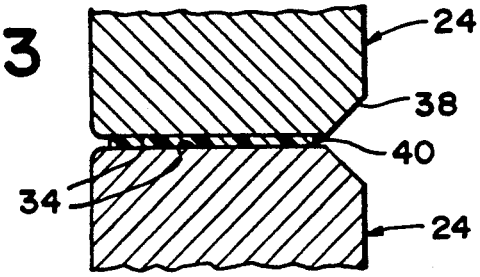
FIG. 3 is an enlarged cross-sectional detail through a typical panel-to-panel edge joint.

Noting FIG. 2, the panel edges 34, other than for an outer bevel or chamfer 38, are planar and without interlocking ribs, shouldered portions or the like as in the more conventional panels and as heretofore considered necessary to provide for a rigid interlock between the panels and along the defined joints. The planar edge construction of the rhombus panels of the invention allow for simpler forming and assembly techniques, a reduced tendency for edge damage, and a greater bearing surface for pressure distribution.

It is contemplated that the linear joints be "drainage joints", provided with an appropriate compressible joint material 40 such as Tensar drainage net which is a high density polyethylene (HDPE) plastic in an open web texture. This material will allow drainage of water, has a long term durability and can provide controlled compression to match the consolidation of the soil. Normally the thickness of the open joint will be approximately ⅜ inches, closing to approximately ¼ inch under full load pressures. If necessary, the joint can close completely without damage to the flat panel edges.

Even should the linear joints close completely, an effective drainage system for ground water is provided by weep holes 42 automatically formed upon assembly of the panels at each point of intersection of four panels. The weep holes 42, assuming panels as initially described, will be approximately 2 inches high and 3.5 inches wide. The weep holes are formed by truncating the four angles of each panel 24, defining, at the apex angle 28 and base angle 30 a horizontal flat of 3.5 inches and at the opposed side angles a vertical flat of 2 inches. Thus formed, and noting FIG. 4, the assembly of the panels into the isometric grid automatically defines the weep holes. In order to prevent soil from washing out of the weep holes, a rigid geotextile filter material 44 can be positioned in the fill overlying the inner face of each weep hole. A material such as Exxon Chemicals Tiger Drain can be used for this purpose.

The horizontal flats at the apex and base angles additionally function as a means for accommodating clamps for engaging and lifting the panels 24, with the spaced vertical and horizontal flats at each block corner assembly allowing for an accommodation of the panel clamping means both as the panels are positioned and subsequent to the positioning of the panels for removal of the clamps. Thus, embedded lifting inserts, as is commonly associated with retaining wall panels, are not required. This will save the cost of the lifting insert, both in materials and assembly expenses, avoid problems with corrosion of the exposed metal, and avoid pockets where water can collect and freeze.

In order to provide a finished appearance to the top of the wall system 20 in accord with the lay of the land or backfill 22 therebehind, the system includes modular horizontal half panels 50 which are equal in size and configuration to the horizontally extending lower half of a standard modular panel 24 and similarly includes a truncated bottom angle 52 of approximately 120° with two planar lower edges 54, equal in length to the lower edges 34 of panel 24, extending therefrom. The panel 50 is completed by a horizontal upper edge 56 meeting, at the opposite ends thereof, the upper ends of the lower edges 54 at truncated 30° angles. These edges, as with the edges of panel 24, are planar.

Noting the schematic illustration of FIG. 6, it will be appreciated that the effective slope of the top of the wall can vary in accord with the number of half panels and full panels used therealong. It is of particular significance to note that the maximum angle, assuming the use of all full panels 24 along the top edge, and no half panels, will be 30°, the slope at which soil backfill is normally considered to be stable. The use of horizontal half panels 50, in accord with the lay of the land desired, will inherently result in a lesser slope. As an example of the various slopes achieved, attention is directed to the following table:

| Half Panels | Full Panels | Degree of Slope |
|---|---|---|
| 4 | 1 | 3.67° |
| 3 | 1 | 4.72° |
| 2 | 1 | 6.59° |
| 1 | 1 | 10.89° |
| 1 | 2 | 16.10° |
| 1 | 3 | 19.11° |
| 1 | 4 | 21.05° |
| 1 | 5 | 22.41° |
| All Full Panels | | 30.0° |

Regardless of the panel arrangement used, there is no abrupt vertical changes in elevation, thus allowing the soil backfill to follow the top of the wall profile. Should particular circumstances require a straight line slope, specifically formed triangular panels can be formed for use with the upper course of full and horizontal half panels.

In order to define a straight line vertical edge for the wall system 20, the system includes vertical half panels 60, each comprising an equilateral triangle corresponding to one-half of a modular panel 24 divided along the vertical centerline 26 thereof. These vertical half panels 60, noting FIG. 1, will alternate with the full modular panels 24 vertically along the wall system at an end thereof, and define the straight vertical edge 62. The 60° angles of the vertical half panels 60 will be truncated as appropriate to define, in conjunction with adjoining components, the desired weep holes. The edges of the panels 60 will be planar and chamfered at the outer panel faces.

Figure 8:
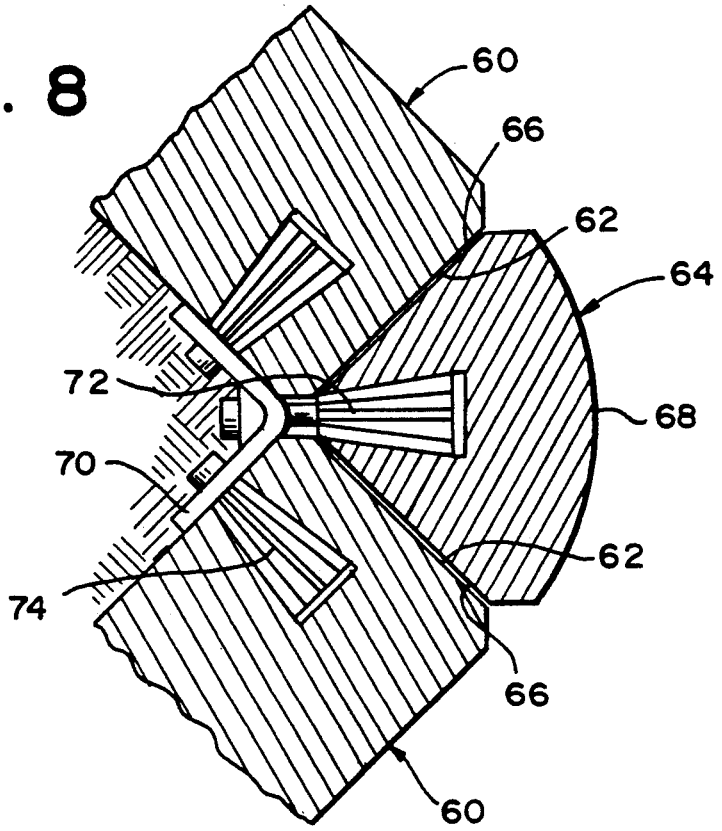
FIG. 8 is a cross-sectional detail through an outside corner between adjacent vertical wall systems.

If the vertical edge 62 of a formed wall, defined by the stacked vertical half panels 60, is to adjoin a similar vertical edge 62 of a second wall and form an outside corner therewith as illustrated in FIG. 8, the planar vertical edges will be joined by an interposed cast concrete nosing 64, preferably formed by a series of vertically aligned nosing pieces. The nosing pieces will be made in two standard lengths, 2¼feet and 4½feet for panels of the above designated size.

The nosing 64 includes two flat sides 66 engaged with the vertical edges 62 of the adjacent walls and at an angle to each other corresponding to the desired angle between the two walls. The outer face 68 of the nosing 64 follows an arc so defined whereby the outer faces of the two walls are in planes generally tangential to the arc.

Each nosing piece, normally coextensive with the vertical edges of two angularly adjacent vertical half panels 60, includes an inwardly spaced angle bracket 70 mounted by studs 72 extending through the inner or apex angle of the nosing and embedded within the concrete material thereof. The bracket 70 is sufficiently inwardly spaced from the nosing piece as to engage against the inner faces of the two adjoining vertical half panels 60, and is directed bolted to each of these panels by appropriate bolts engaging through the brackets and into anchoring sockets 74 embedded within the panels 60 when formed. In this manner, the two angularly adjacent side panels 60 and the nosing piece therebetween define a complete unit. As desired, the embedded studs can be replaced by embedded anchor sockets which receive corresponding bolts as with the sockets 74.

The angle of the nosing sides 66 will be set in accord with the desired angle between angularly adjacent walls. It is contemplated that the forming of the nosings be achieved utilizing a molding system and apparatus with an arcuate base mold side for the outer face and a pair of planar mold sides extending radially inward therefrom toward a common center to define the nosing sides 66, the radially extending sides being laterally adjustable toward and away from each other in any appropriate manner.

Figure 9:
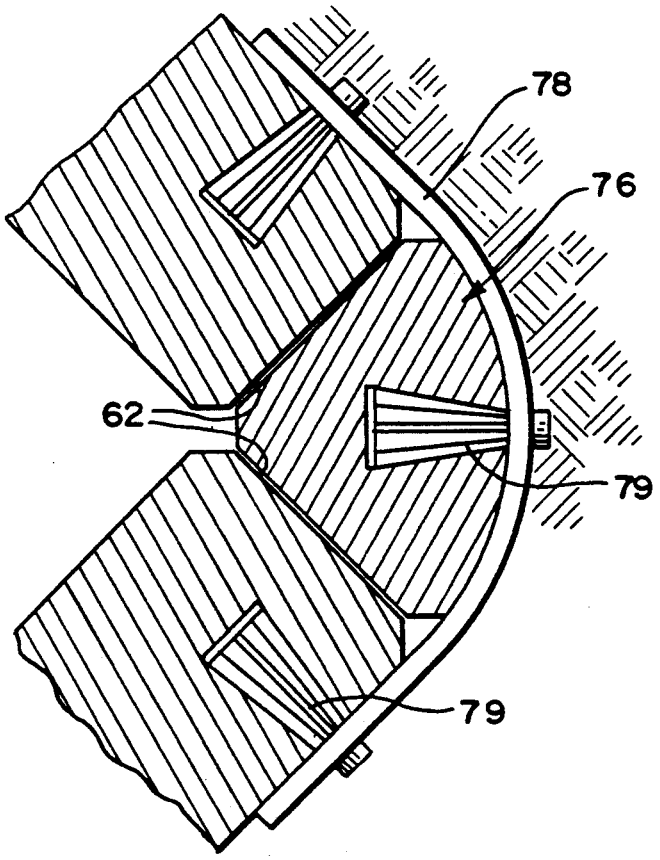
FIG. 9 is a cross-sectional detail through an inside corner between adjacent wall systems.

FIG. 9 illustrates a corresponding inside corner with an inside angle nosing 76 similar to the outside nosing 64 and with a modified anchoring system. The inside corner anchoring system utilizes arcuate metal scraps 78 overlying the arcuate outer faces of the nosing pieces and anchor bolts through the straps and into anchor sockets 79 embedded in the nosing pieces and adjoining vertical half panels.

Figure 10:
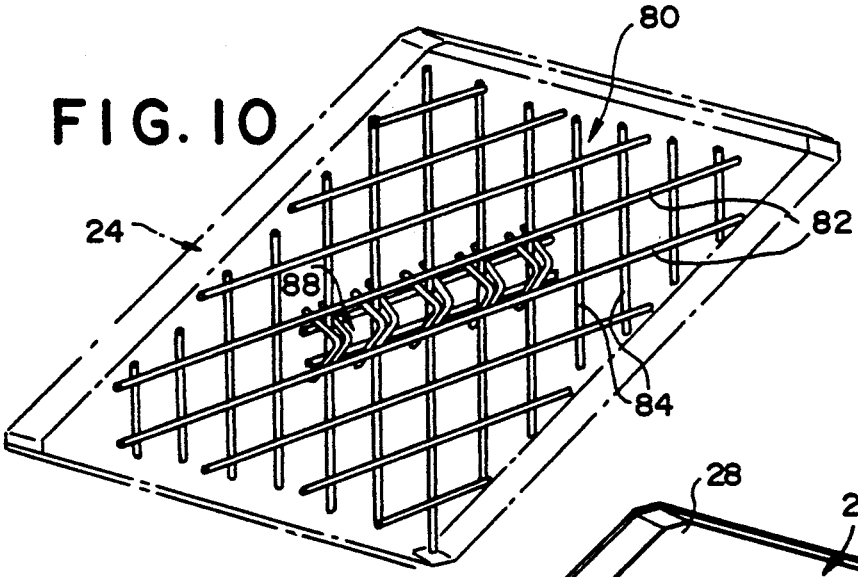
FIG. 10 is a perspective view of the panel reinforcement system and connector extending therefrom.
Figure 11:
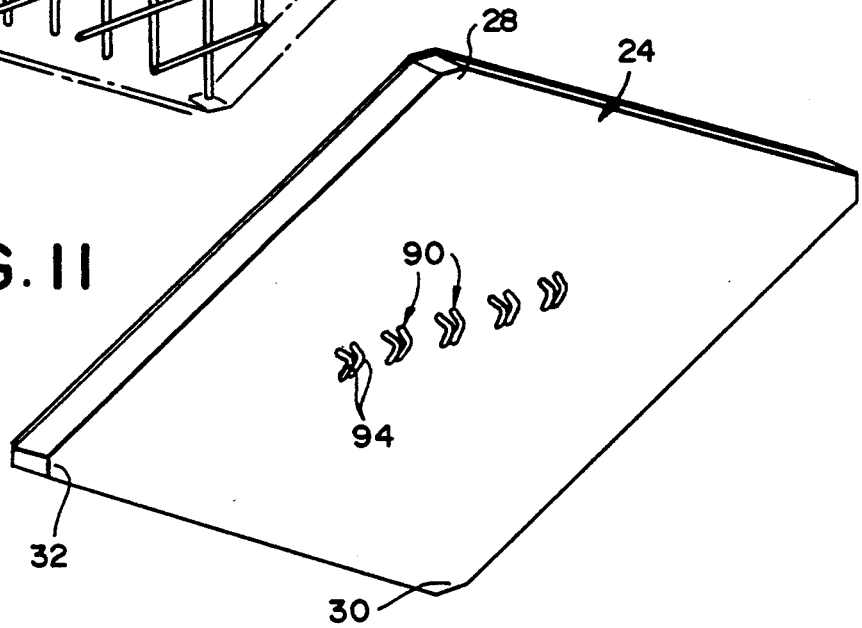
FIG. 11 is a perspective view illustrating the rear of a modular panel with the connector projecting therefrom.
Figure 12:
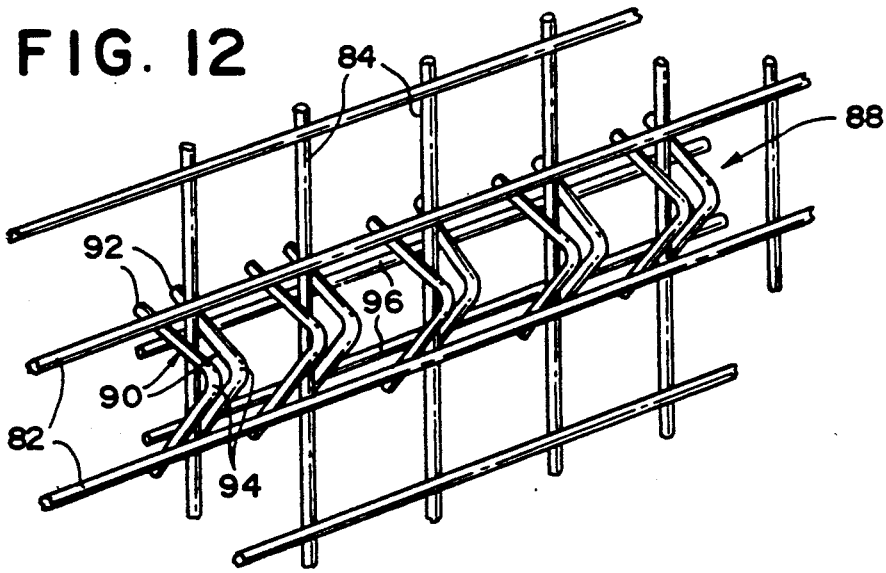
FIG. 12 is an enlarged detail illustration of the connection engaged with a panel reinforcement mat.
Figure 13:
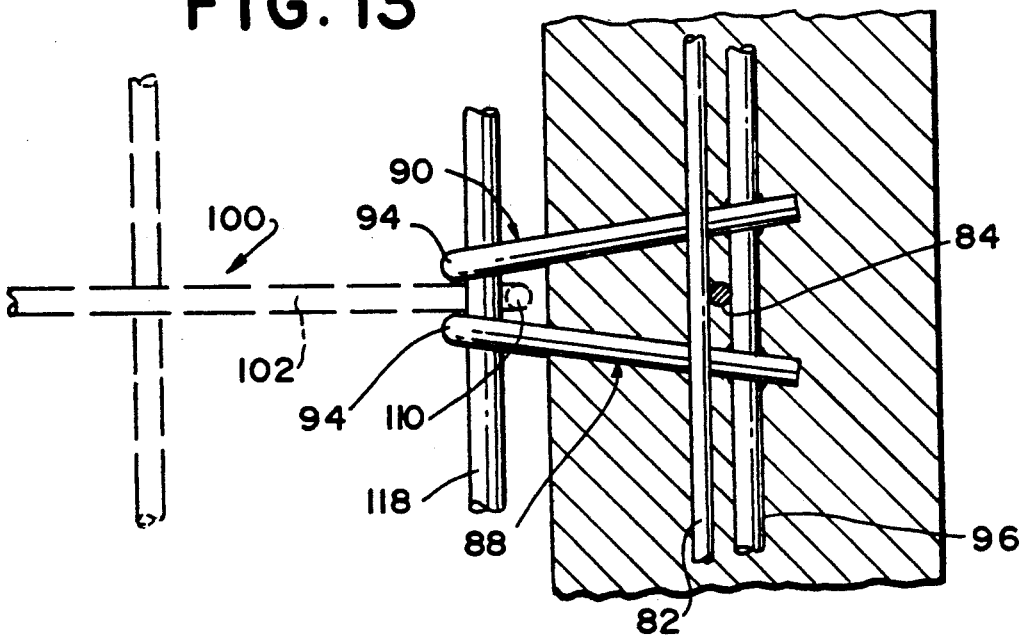
FIG. 13 is a horizontal cross-sectional view through a panel and illustrating the panel reinforcement mat and a soil embedded reinforcement mat.

Noting FIG. 10, each of the panels 24 is internally reinforced by a welded steel wire mat 80 of deformed wire. The mat is preferably to be galvanized with bright plated zinc.

In the typical panel 24, as above described, the bars or wire are of D6 size, having a diameter of 0.276 inch and a cross-sectional area of 0.060 square inches. The mat 80 itself will be 4 feet wide and 6 feet, 4 inches long with 8 horizontal bars 82 and 13 vertical bars 84 spaced 6 inches on center both vertically and horizontally.

The reinforcing mats 80, as a matter of manufacturing expediency, will be cut on an isometric grid from large sheets in the producer's plant with a pneumatic shear or the like. When centered within a poured concrete panel 24, the mat will be covered by at least 2 inches of concrete continuously along the edges of the panel and to each planar side of the mat.

In the formed wall system 20, each of the panels 24 will connect to a soil reinforcement grid or grid system 86 through or by means of a connector 88 of welded galvanized round bars extending horizontally along the horizontal center line of the panel 24 and engaged with five of the vertical bars 84 of the mat 80, including the central bar and the two bars to each side thereof. The physical contact between the reinforcing mat 80 and the connector 88 provides for a common electrical ground in situations where there may be stray electrical currents in the soil and the buried metal must be maintained at the same electrical potential.

The connector 88 is a ganged unit of five pairs of angular connecting bars 90 with the legs 92 thereof diverging at approximately 60° to each other from a rounded apex 94 projecting approximately 1½inches from the rear face of the panel 24. Each connecting bar 90 is vertically oriented with the legs 92 thereof extending between and beyond the horizontal rods 82 of the reinforcing mat 80 immediately to each side of the horizontal center line of the mat and panel 24.

The embedded end portions of the ganged pairs of connecting bars 90 are interconnected in a unitary assembly by upper and lower horizontal base bars 96 extending across and welded to the legs 92. The base bars are inward of and engage against the vertical bars 84 of the reinforcing mat 80.

The connecting bars 90 of each pair of bars are positioned to receive a vertical bar 84 of the reinforcing mat 80 therebetween with the connecting bars of each pair being spaced approximately 2 inches at the base bars and converging toward each other rearward of the embedded reinforcing mat 80 and terminating with the apex ends 94 thereof approximately ½ inch apart.

The connector 88, in addition to its primary function of providing for a positive joinder of the reinforced panel 24 to the soil reinforcing grid system 86 associated therewith, also functions as a support system for the panel reinforcing mat 80 at the forming stage, prior to and during pouring of the concrete. In addition, the connector 88 comprises the means by which the formed panels are to be lifted from the molds in the stripping and yarding stage of panel manufacture.

Noting FIG. 16, the connectors 88 can be cut from continuous grids 98 of welded wire or rod, 25 inches wide or a multiple thereof, for example 75 inches. The length of the sheet will be a multiple of 11 inches, and as long as can be efficiently handled. The sheet, or grid 98 is cut into 11 inch lengths, bent at the desired 60° angle, (FIG. 17) and hot-dipped galvanized. If the original sheet width is, as an example, 75 inches, this constitutes a triple width which will be field cut into three connectors. The general sequence of steps involved will be noted in FIGS. 16–18. FIG. 18 illustrates the additional step of centrally inwardly deforming the connecting bars 90 to achieve the desired convergence thereof at the 60° apex of the folded bars.

As will be appreciated, the connectors to be associated with both the horizontal half panels 50 and vertical half panels 60 are to be appropriately foreshortened and positioned for complete embedment within the respective panels at mid-height and with at least 2 inches of concrete peripherally thereabout.

Each of the panels 24 is engaged with and anchored by a soil reinforcement grid or grid system 86. Each grid 86 will be defined by a wire mat or mats 100 formed of five longitudinal rods 102 on 6 inch centers for a total width of 2 feet, and transverse rods 104 on 6 inch centers for grids less than 14 feet in length, and on 12 inch centers for grids greater than 14 feet in length.

The typical stock length for the grid mats 100 will be anywhere from 8 feet to 20 feet at 2 foot increments. The length of the grid 86 defined will vary in accord with the specific conditions of the job, and will usually be approximately be 70% of the wall height. For grid lengths longer than 20 feet, grid mats 100 of the appropriate combined length will be spliced together to define a continuous planar mat. For example, walls up to 20 feet in height will use a single grid mat per panel, walls 21 to 40 feet in height will use two aligned and spliced grid mats, and walls 41 to 60 feet in height will use three aligned and joined soil reinforcement grid mats per panel.

For walls of greater than 60 feet in height, the grid mats will be formed of larger size rods with a greater yield strength. When forming walls with reinforced concrete panels dimensioned as previously mentioned, steel rods with a yield strength of 65,000 PSI up to 72,500 PSI will normally be used.

Figure 14:
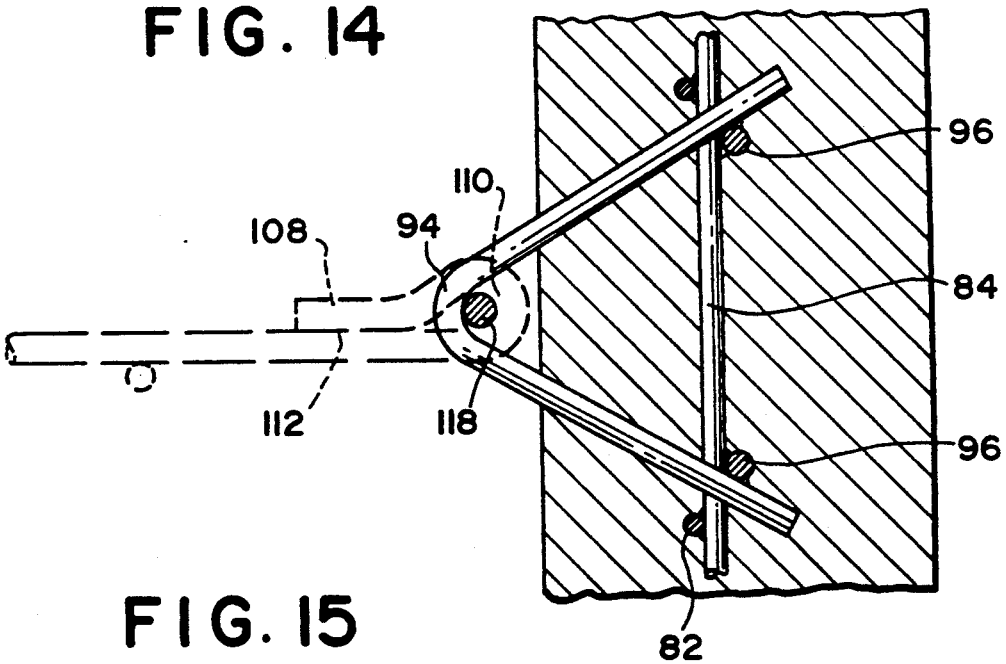
FIG. 14 is a vertical cross-sectional detail of the structure of FIG. 13.
Figure 15:
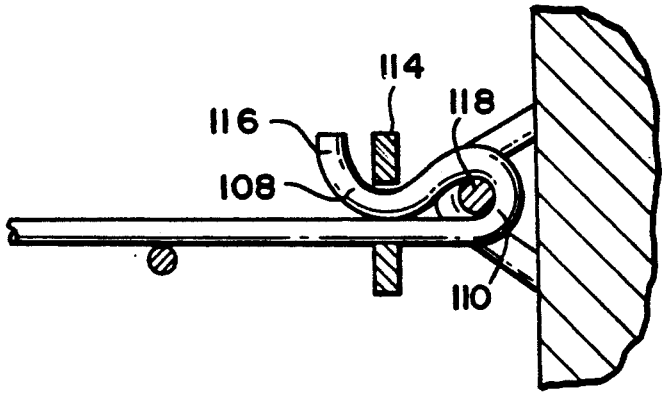
FIG. 15 is a cross-sectional detail illustrating a modification of the manner of securing the soil reinforcement mat to the connector.
Figure 19:
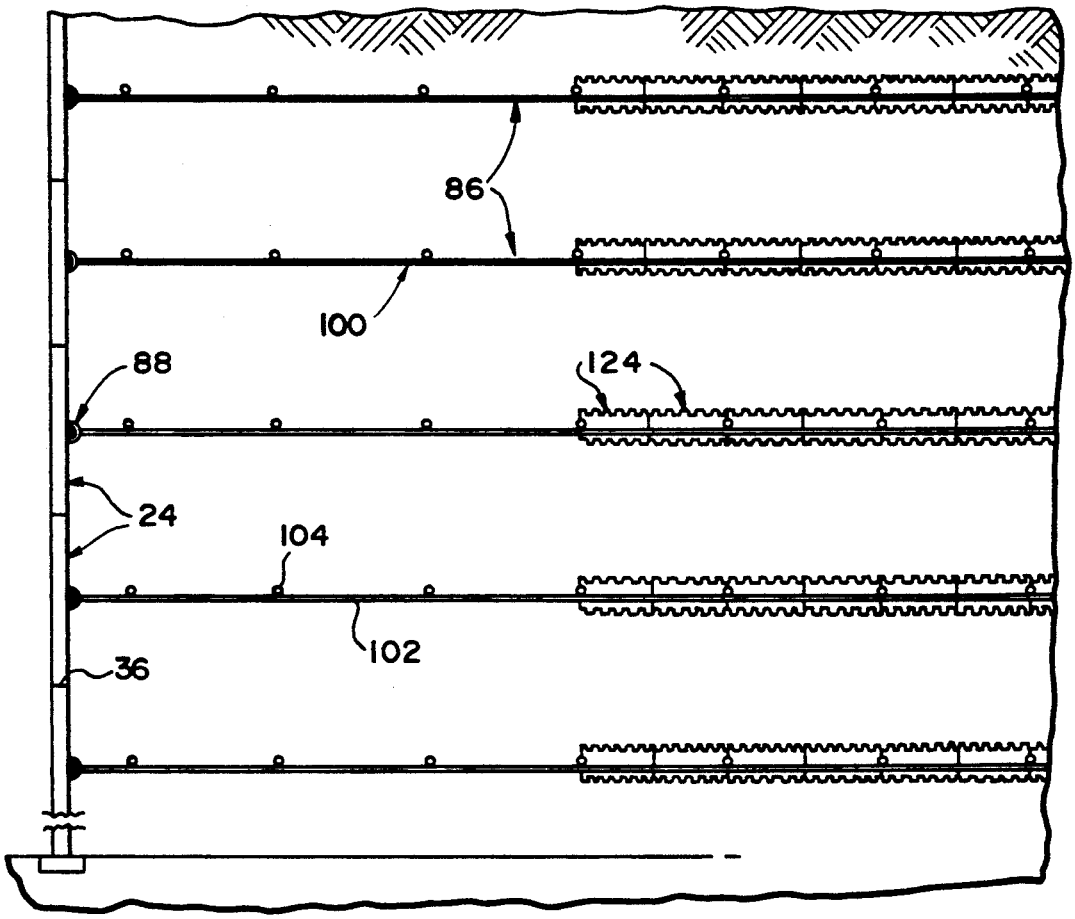
FIG. 19 is a schematic side elevational view of the earthwork system of the invention illustrating the soil reinforcement grids and friction blocks.

At the panel end of each grid mat 100, the longitudinal bars 102 will have the extreme ends thereof, as at 108, reversely formed on themselves to define a vertically oriented loop 110. The reversely folded end portion 108 of each rod 102 can be resistance welded directly thereto as at 112 in FIG. 14. As an alternatively the reversely folded rod end portion 108 can be retained in the loop-defining configuration by a steel washer 114 engaged over the wire and end portion inward of the loop 110 and positionally fixed by the upwardly curled extremity 116 of the end portion 108.

Each soil reinforcement grid 86, and more particularly the first mat 100 thereof adjacent the corresponding panel 24, has the five loops 110 thereof respectively received between the five pairs of connecting bars 90 of the corresponding connector 88, aligning therewith immediately inward of the apex angles 94. The reinforcement grid mat 100 is secured to the connector by a horizontally introduced elongate rigid steel locking bar 118 which extends through all of the defined loops 110 and seats within the formed apex angles 94 of the connecting bars 90. Such an interlocking of the soil reinforcement to the panels greatly simplifies wall construction and soil reinforcement placement in that as the backfill level is brought up to mid-height on the panels, the soil reinforcement grids are laid horizontally thereon extending inward of the panels and mounted thereto by the installation of the horizontal locking bars 118.

Figure 21:
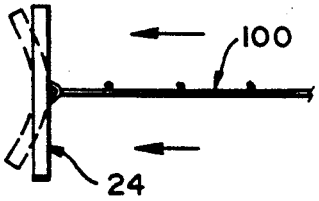
FIG. 21 is a schematic illustration of the loading of the panels of the invention.
Figure 22:
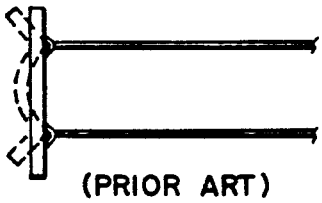
FIG. 22 is a schematic illustration of the loading of a conventional prior art panel.

It is particularly significant that the soil reinforcement grid associated with each panel 24 engage the panel solely along the horizontal center line thereof. In this manner, the entire panel 24, noting the schematic illustration of FIG. 21, resists the soil load therebehind by functioning in the manner of a cantilever, as seen in the exaggerated phantom line deflection, with the inner face of the panel subjected solely to tension throughout the extent thereof and with the outer face of the panel subjected solely to compression. As such, placement of the internal panel reinforcement need only accommodate the anticipated tensile load in a single plane. In the more conventional panel anchoring system, as in FIG. 22, each panel is normally reinforced by upper and lower soil embedded anchoring systems. Thus, the panel itself is subjected to a combination of different forms of stress from the soil retained thereby. For example, the vertical central portion of the panel, supported to the upper and lower sides thereof, will function in the manner of a beam and will be subjected to compressive forces on the soil engaging inner face thereof and tension forces on the outer face. At the same time, the upper and lower extremities of the panel, beyond the upper and lower soil embedded reinforcements, will be subjected to cantilever loading with tension on the inner faces thereof and compression on the outer faces, exactly opposite from those stresses generated in the central portion of the block. This loading of the conventional panel has been illustrated by the exaggerated showing in phantom lines. As such, and as will be readily apparent, placement of the panel reinforcement will be complex and require great care if it is to effectively accommodate the different loading situations encountered in a single panel.

In order to improve soil pull out resistance of the welded wire soil reinforcement grids, without modification of the grids themselves as by introducing a nonstandard transverse bar spacing, the invention also contemplates the use of precast concrete friction blocks 124.

The blocks 124 will normally be used in conjunction with the grids having transverse bar spacing of 12 inches, such being used for walls of greater height wherein enhanced soil pull out resistance becomes more significant. Thus, each friction block will be sized as to fit within the space defined by adjacent longitudinal and transverse rods 102 and 104, such space measuring approximately 6 inches by 12 inches, base on a 6 inch by 12 inch center-to-center wire spacing.

Each friction block provides 1 square foot of friction area for every linear foot of transverse bar bearing area against the soil. As an example, when using W11 wire, having an effective bearing area of 0.00262 square feet, the friction block 124 will provide a 382 times increase in the effective bearing area.

The friction blocks 124 are used in pairs with each block being 2⅛inches thick, 6¼inches long and 6 inches wide. One transverse end 126 has a V groove therein which, upon a horizontal positioning of the block 124, seats on a transverse wire 104 of the corresponding soil reinforcement grid mat. The opposite transverse edge 128 of the block is flat and abuts, flat face to flat face, with an oppositely directed friction block 124 which has the remote V-notched end 126 engaged with the next adjacent transverse rod 104. The opposed side edges of each friction block are inwardly offset, as at 130, along the full length thereof and for approximately ¾ inch upward from the lower face of the block 124 so as to define a longitudinal downwardly directed support shoulder 132, approximately ¼ inch in width. These shoulders 132, which may be slightly chamfered, seat on the adjacent longitudinal rods or wires 102 which define the space receiving the pair of friction blocks 124. The pair of friction blocks are thus supported on the reinforcing wire peripherally thereabout. In order to enhance the effectiveness of the friction blocks 124, the top and bottom surface of each block are formed with transverse alternating ribs 134 and grooves 136, parallel to the end edges 126 and 128 so as to extend transversely of the soil reinforcement mat 100. The grooves are approximately ¼ inch deep and are on approximately 1 inch centers. The sides of the ribs and grooves will slope at approximately 45°. Thus formed, the ribs and grooves trap soil particles and insure maximum friction with the soil layers.

Figure 20:
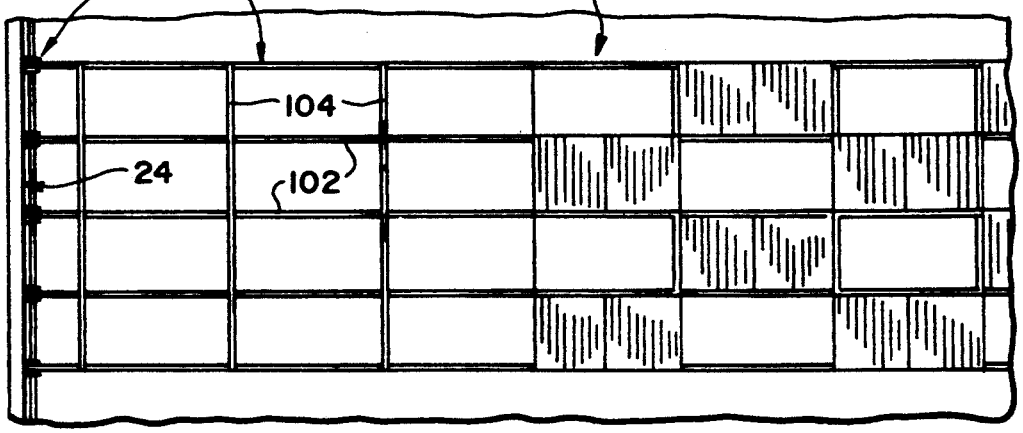
FIG. 20 is a to plan view of a soil reinforcement grid with friction blocks.

The friction blocks will normally be placed in the soil reinforcement grids in a checkerboard or alternating pattern as illustrated in FIG. 20, and used only in the effective length portion of the grid, that portion which rests behind the failure plane of the soil.

Turning now to the actual forming of the precast concrete modular panels 24, it is proposed that this be done utilizing either individual molds or gang molds. Noting FIG. 26, the individual or stand-alone mold 140 comprises a bottom plate 142 of rhombus configuration and corresponding to the shape of the panel to be formed. The bottom plate is peripherally engaged by four metal side rails 144, preferably comprising vertically oriented channeled bars with the planar back faces 146 thereof engaging the edges of the bottom plate 142 and projecting vertically thereabove to define the forming faces for the planar edges of the modular panel 24.

Inasmuch as the side rails 144 are to define, in the positioned panel 24, vertically aligned or upper and lower angles of 120° and horizontal angles of 60°, each of the rails 144 has, at the end thereof defining one of the vertical angles, a transverse end plate 148 welded thereacross and extending laterally beyond the corresponding end of the rail at an angle of 120° to the outer face of the rail. The opposite end of each side rail 144 is similarly provided with an angularly directed and outwardly projecting end plate 150 extending at a 150° angle to the outer face of the rail. As will be appreciated, the ends of the rails 144 are cut to accommodate and conform to the corresponding end plates.

Upon a peripheral alignment of the side rails 144 about the bottom plate 142, the end plates 148 will engage against each other to define the upper and lower panel angles of 120°. At the same time, the end plates 150 will engage at the opposed sides of the mold to define the side panel angles of 60°. The projecting portions of the end plates 148 and 150 will then be releasably secured, as by bolts 152 extended through aligned end plate apertures.

In order to truncate the panel angles, to define the flats which form the wee holes, each of the side rails 144, at each end thereof, includes a forming block 154 extending inwardly of and along the full height of the forming face 146 of the rail 144 between the bottom panel 142 and the top edge of the rail. Each forming block includes a first face defining a planar continuation of the outer face of the adjacent end plate 148, 150, and a second face at right angles thereto. Thus, and noting FIG. 26, at each pair of adjacent rail ends, the corresponding forming blocks 154 will abut each other and define a planar forming face which in turn provides the truncation desired in the formed panel 24.

Noting FIG. 28, appropriate 45° forming blocks 156 will also be provided peripherally about the mold 140 at the corners defined between the bottom plate 142 and the rails 144 to the chamfered edges in the panel 24.

The wire reinforcing mat 80 and the connector 88 are positioned within the mold 140 prior to pouring of the concrete, and are positionally maintained by an elongate support tube or bar 160. The support 160 is rectangular in cross-section and oriented with a pair of the angle edges vertically directed and aligned. The opposed ends of the support tube 160 have rigid apertured metal plates 162 welded or otherwise secured thereto. These plates depend from the tube 160 and align with the projecting end plates 150 at the side angles of the mold 140 for a bolting thereto, normally by the same bolt 152 used to interlock the rail end plates 150. The support tube 160, thus mounted, extends centrally across and in vertically spaced relation above the mold. Mounted in this manner, the support tube 160 provides for a significant strengthening of the mold 140 by triangulation.

The lower angle edge portion of the support tube 160 is formed with a series of notches 164 transversely thereacross and longitudinally spaced along the support tube to correspond to the spacing of the pairs of connecting bars 90 for engagement of the apex ends 94 therein. Thus, in order to accommodate the two connecting bars of each pair of bars 90, the corresponding notches will be spaced approximately ½ inch from each other. Similarly, these two notches will be spaced approximately 4½inches from the next pair of notches for the next pair of connecting bars 90.

The apex ends 94 of the connecting bars 90 of the connector 88 are received upwardly through the corresponding notches 164 and are fixed in position by the introduction of an elongate support rod 166 through the support tube 160 and the aligned apex ends 94. The support rod 166, retained by the tube 160 and in turn supporting the connecting bars 90, will in an obvious manner prevent downward retraction of the connecting bars from the notches, thus providing for a suspension of the connector 88, and the panel reinforcing mat 80 carried thereby, from the support tube 160. For ease of handling, the support rod 166 can be provided with a T-head on one end thereof.

In view of the manner in which the connector 88 engages and supports the reinforcement mat 80, with the spread legs 92 of the connecting bars 90 and the base bars 96 providing a substantial degree of stability to the mat 80, the mat 80 may freely seat on the connector 88 or be tied thereto, without requiring a positive welded connection.

Figure 30:
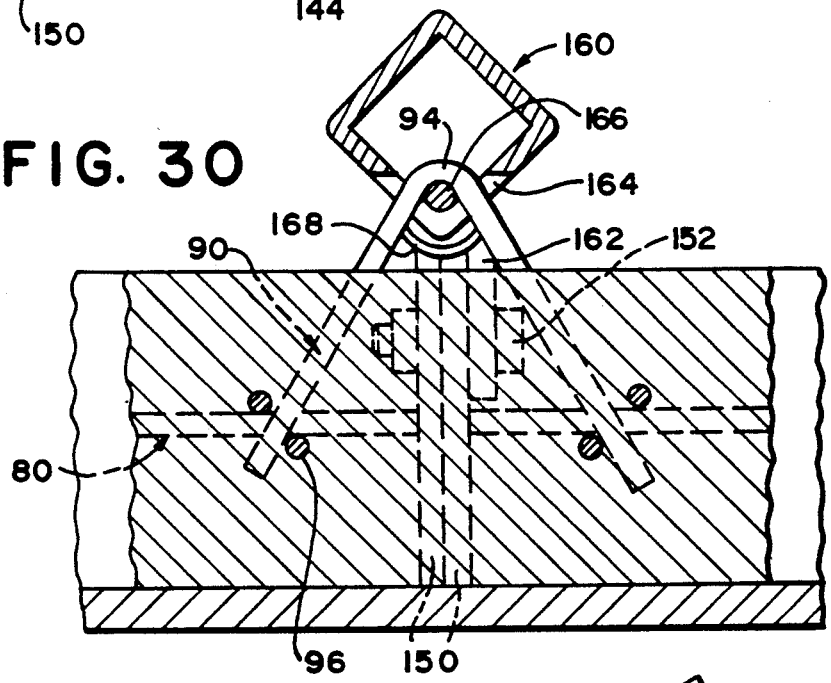
FIG. 30 is a transverse cross-sectional view taken substantially on a plane passing along line 30—30 in FIG. 29.
Figure 31:
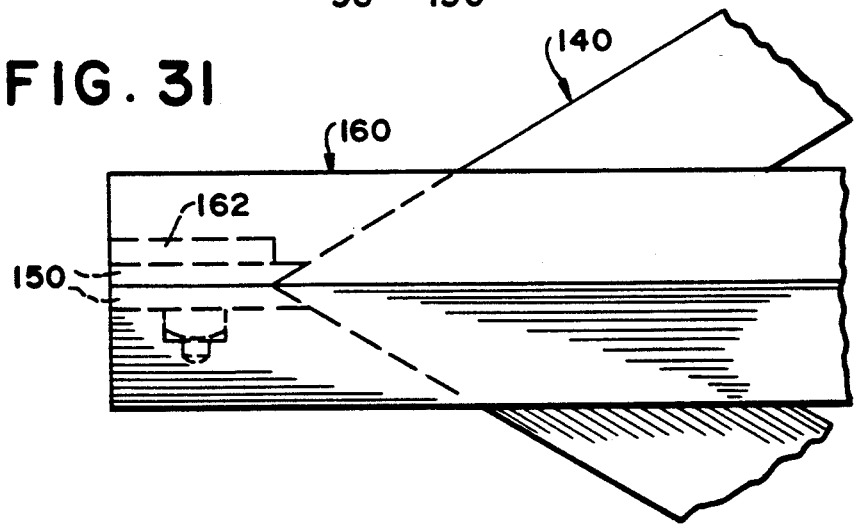
FIG. 31 is a top plan view of the structure of FIG. 29.

Noting the detail of FIG. 30, in order to insure that the relatively small ½ inch spacing between the connecting bars 90 of each pair of bars be maintained clear during and after the concrete pouring operation for the subsequent accommodation of the looped ends 110 of the soil reinforcement mats, a spacer 168, in the nature of a semi-cylindrical pipe section, will be welded to the support tube 160 between the notches 164 which receive each pair of bars 90. These spaces, as shown, will envelope the lower angle. This insures the exclusion of concrete and provides adequate spacing in the poured panel for accommodation of the end loops of the soil reinforcement grids. The spacers 168 will be ½ inch wide to correspond to the spacing between the connecting bar notches 164, and approximately 1 1/14 inches in diameter to provide a space which will easily accommodate the loops 110.

Figure 32:
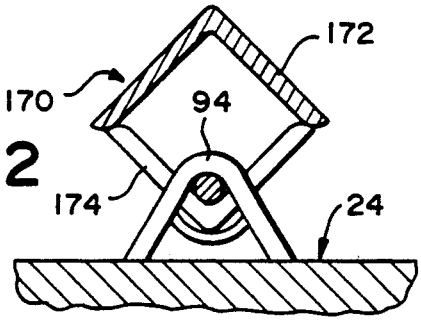
FIG. 32 is a cross-sectional detail similar to FIG. 30 and illustrating a modified form of support tube.

FIG. 32 illustrates a variation wherein the support tube 170 is formed of opposed welded angle bars 172 and 174. The lower bar can be formed in separate segments to define the notches to receive the connecting bars 90.

Subsequent to a setting of the cast concrete, the support tube 160 is removed and the formed panel 24 lifted from the mold 140 using the projecting apex portions 94 of the connector 88.

Figure 33:
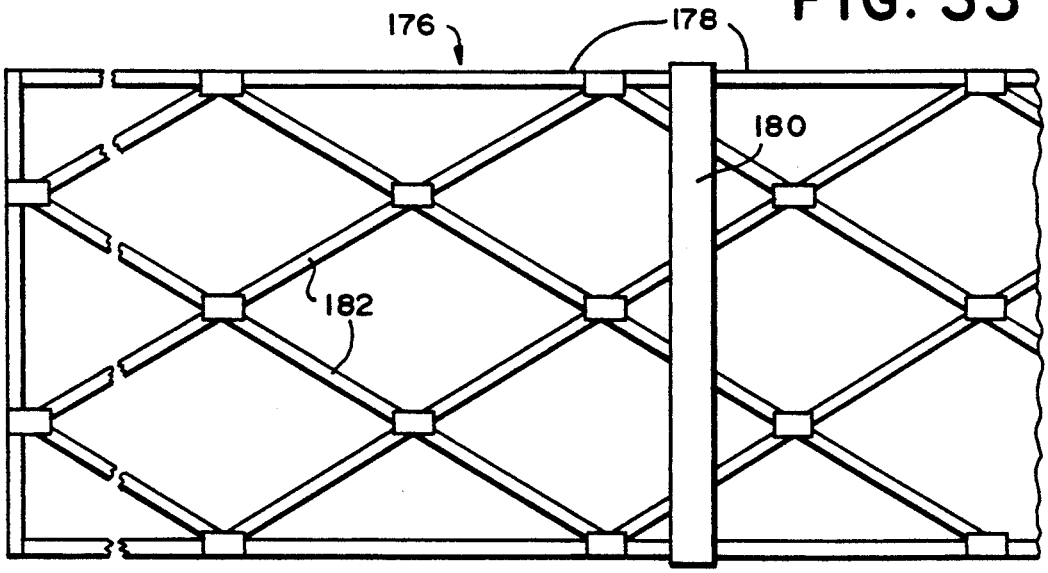
FIG. 33 is a schematic top plan view of a gang mold for the panels of the invention.
Figure 29:
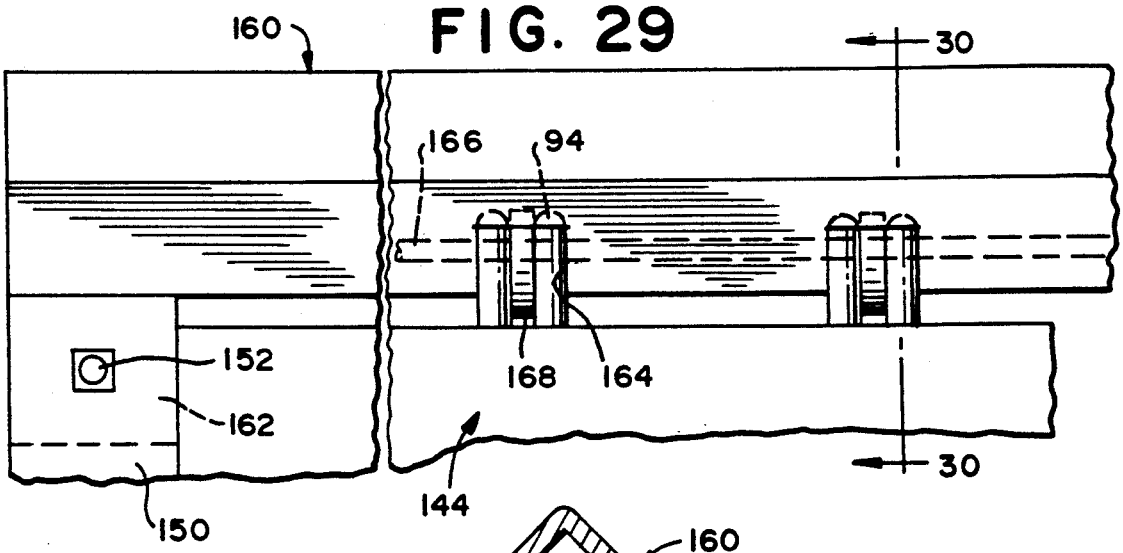
FIG. 29 is an elevational detail of the support means for the panel reinforcement.

As broadly suggested in FIG. 33, the panels, both the primary modular panels 24 and the horizontal and vertical half panels 50 and 60, can be formed within a continuous gang mold 176. The gang mold 176 will include side rails 178 formed of joined sections and defining a support surface for the longitudinal travel of the transversely extending vibratory screed 180. Between the side rails, the mold is formed in the manner of an isometric grid with intermediate form members 182 extending at the desired 30° angle to the parallel side rails 178.

It is preferred that the gang mold 176 be set up on a smooth flat surface with the rails 178 and 182 being removable without moving the cast panels. This will enable the mold components to be quickly recycled as compared to casting procedures wherein the mold is not available until the cast member is physically removed therefrom.

With the gang mold, provision will also be made, similar to that provided for in the individual molds, for the support of the panel reinforcing mats through the connectors which engage the mats and suspend the mats from appropriate overlying support members.

The foregoing is illustrative of an earth stabilization system utilizing uniquely designed support panels and a wall system formed therefrom which is distinctly superior to known prior art structures. This is achieved in large part by the provision of a system which accommodates the natural flow tendencies of the soil to achieve maximum stabilization with unique although structurally uncomplicated components. The system of the invention also provides for a distinctive reinforcing system for the retained soil whereby the individual panels are tied to the soil reinforcement which, through the use of modular friction blocks, can have the effective strength thereof varied in accord with the anticipated loads, generally a function of the height of the wall to be formed.

It is to be appreciated that within the scope and parameters of the invention as above detailed, modifications and variations may be resorted to.

I claim:

1. An earthwork system comprising an earth retaining wall formed of modular panels, said modular panels including an apex angle with upper panel edges extending downwardly therefrom at an approximate angle of 120° to each other, and a base angle with lower panel edges extending upwardly therefrom at an approximate angle of 120°, said upper edges and said lower edges meeting at a pair of opposed side angles of approximately 60°, said panels being generally isometric grid with continuous joint lines between the stacked panels extending at approximately 30° to the horizontal in crossing relation to each other to define said isometric grid and to define lines of free movement generally corresponding to the natural shear planes of consolidating soil retained by said wall, said panel edges extending along corresponding edges of adjacent panels to define said joint lines and for accommodating longitudinal relative movement between adjacent panels along said lines of free movement in response to soil consolidating whereby shear stress within the individual panels is minimized.

2. The earthwork system of claim 1 wherein said panels are each defined by a pair of horizontally aligned equilateral triangles with a common vertical base line extending therebetween and bisecting said apex and base angles.

3. The earthwork system of claim 2 wherein said panels are stacked horizontally adjacent each other in horizontal courses with said side angles of horizontally adjacent panels on a common horizontal line, and vertically adjacent to each other with said apex and base angles of vertically adjacent panels on a common vertical line.

4. The earthwork system of claim 3 wherein panel junctures are defined between the apex angle of a panel, the base angle of a panel immediately thereabove, and the adjacent side angles of a pair of panels immediately horizontally adjacent thereto, said apex, base and side angles being truncated, at each juncture said apex and base angles being vertically spaced and said side angles being horizontally spaced to define a weep hole transversely through said wall, said panels, outward of said juncture weep holes, being in edge-to-edge supporting relationship and defining said continuous joint lines to each side of and continuously across said weep holes.

5. The earthwork system of claim 4 including horizontal edge panels, each said horizontal edge panel comprising a half modular panel triangular with a base angle and lower panel edges corresponding to the base angle and lower panel edges of a modular panel, and a horizontal upper edge opposed from said base angle of said horizontal edge panel on a line corresponding to a horizontal line between said side angles of a modular panel, said horizontal edge panels engaging between selected ones of adjacent uppermost modular panels and defining therewith an upper edge contour for said wall.

6. The earthwork system of claim 5 including vertical edge panels, each said vertical edge panel comprising a vertical half of one of said modular panels, including a side angle of approximately 60°, upper and lower panel edges diverging therefrom, and a vertical base edge opposed from said side angle of said vertical edge panel and of substantially equal length with said upper and lower panel edges of said vertical edge panel, said vertical edge panels engaging between selected ones of adjacent sidemost modular panels.

7. The earthwork system of claim 4 wherein all of said panel edges are planar, and including compressible drainage material between said panel edges along said joint lines outward of said weep holes.

8. The earthwork system of claim 4 including soil reinforcement mats, and connector means on selected panels, each connector means connecting a soil reinforcement mat to the selected panel with the mat extending laterally from the panel.

9. The earthwork system of claim 8 wherein each of said modular panels includes an internally embedded reinforcement mat, each of said connector means being in supporting engagement with a panel reinforcing mat and projecting exteriorly from the corresponding panel for engagement with the corresponding soil reinforcement mat.

10. The earthwork system of claim 9 including soil friction enhancing blocks selectively mounted within said soil reinforcement mats, said friction blocks including soil-engaging friction enhancing surfaces.

11. The earthwork system of claim 10 wherein each friction block includes peripheral edges selectively recessed to engage with and within said soil-reinforcement mats, said friction blocks, when mounted within said mats, including opposed faces projecting laterally of said reinforcement mats and defining said friction enhancing surfaces.

12. The earthwork system of claim 6 wherein said vertical edge panels define a vertical wall edge, a second similarly formed earth retaining wall having a vertical edge thereof defined by vertical edge panels, said two retaining walls having the vertical edges thereof positioned adjacent each other and defining an angle between said walls, vertically elongate nosing block means positioned between the adjacent vertical wall edges, said nosing block means having planar vertical edges at an angle to each other corresponding to the angle defined by the adjacent vertical wall edges, bracket means extending transversely across said nosing means and portions of said walls to each side thereof, and fastener means securing said bracket means to said walls and said nosing means.

13. The earthwork system of claim 1 wherein panel junctures are defined between the apex angle of a panel, the base angle of a panel immediately thereabove, and the adjacent side angles of a pair of panels immediately horizontally adjacent thereto, said apex, base and side angels being truncated, at each juncture said apex and base angles being vertically spaced and said side angles being horizontally spaced to define a weep hole transversely through said wall, said panels, outward of said juncture weep holes, being in edge-to-edge supporting relationship, and defining said continuous joint lines to each side of and continuously across said weep holes.

14. The earthwork system of claim 13 wherein said panel edges are generally planar, and including compressible drainage material engaged between said panel edges along said joint lines outward of said weep holes.

* * * * *

UNITED STATES PATENT AND TRADEMARK OFFICE

CERTIFICATE OF CORRECTION

PATENT NO. : 5,190,413
DATED : March 2, 1993
INVENTOR(S) : John M. Carey

It is certified that error appears in the above-indentified patent and that said Letters Patent is hereby corrected as shown below:

Column 14, line 17, after "generally" insert --vertically stacked and horizontally aligned in a generally--.

Signed and Sealed this
Eighteenth Day of July, 1995

*Attest:*

*Attesting Officer*

BRUCE LEHMAN

*Commissioner of Patents and Trademarks*